US012263995B2

(12) United States Patent
D'Alfonso et al.

(10) Patent No.: US 12,263,995 B2
(45) Date of Patent: Apr. 1, 2025

(54) PACK PROVIDED WITH AT LEAST ONE BLISTER OPENABLE BY MEANS OF SLIDING

(71) Applicant: G.D SOCIETA' PER AZIONI, Bologna (IT)

(72) Inventors: Lorena D'Alfonso, Bologna (IT); Roberto Polloni, Bologna (IT); Giuliano Gamberini, Bologna (IT)

(73) Assignee: G.D SOCIETA' PER AZIONI, Bologna (IT)

( * ) Notice: Subject to any disclaimer, the term of this patent is extended or adjusted under 35 U.S.C. 154(b) by 86 days.

(21) Appl. No.: 18/041,163

(22) PCT Filed: Aug. 10, 2021

(86) PCT No.: PCT/IB2021/057371
§ 371 (c)(1),
(2) Date: Feb. 9, 2023

(87) PCT Pub. No.: WO2022/034500
PCT Pub. Date: Feb. 17, 2022

(65) Prior Publication Data

US 2023/0294884 A1 Sep. 21, 2023

(30) Foreign Application Priority Data

Aug. 10, 2020 (IT) ..... 102020000019879

(51) Int. Cl.
*B65D 43/20* (2006.01)
*B65B 11/52* (2006.01)
(Continued)

(52) U.S. Cl.
CPC ..... *B65D 43/20* (2013.01); *B65B 11/52* (2013.01); *B65D 75/366* (2013.01);
(Continued)

(58) Field of Classification Search
CPC ..... B65D 43/20; B65D 75/36; B65D 75/366; B65D 75/367; B65D 77/20;
(Continued)

(56) References Cited

U.S. PATENT DOCUMENTS 3,467,248 A * 9/1969 Makowicki ..... B65D 73/0092 206/464
3,707,274 A 12/1972 Hausler et al.
(Continued)

FOREIGN PATENT DOCUMENTS

DE 3407123 A1 8/1985
DE 4408001 C1 6/1995
(Continued)

OTHER PUBLICATIONS

International Search Report and Written Opinion for Corresponding International Application No. PCT/IB2021/057371, mailing date Dec. 8, 2021.

*Primary Examiner* — Bryon P Gehman
(74) *Attorney, Agent, or Firm* — MARSHALL, GERSTEIN & BORUN LLP

(57) ABSTRACT

A pack comprising: at least one product; a blister provided with a pocket, which houses the at least one product and has an open end surrounded by a flat edge, and a closing tab, connected to the flat edge of the pocket to close the open end; and a support body, which houses the blister in a sliding manner to allow the blister to move relative to the support body between a closing position, in which the at least one product cannot be removed from the pocket, and an extraction position, in which the at least one product can be removed from the pocket. A connection end of the closing tab is fixed to the support body in a permanent and inseparable manner so that the sliding movement of the blister relative to the support body from the closing position to the
(Continued)

extraction position causes a progressive separation of the closing tab from the flat edge of the pocket.

12 Claims, 14 Drawing Sheets

(51) Int. Cl.
*B65D 75/36* (2006.01)
*B65D 77/20* (2006.01)

(52) U.S. Cl.
CPC ..... *B65D 75/367* (2013.01); *B65D 77/2032* (2013.01); *B65D 77/2088* (2013.01); *B65D 2251/0021* (2013.01); *B65D 2251/0093* (2013.01); *B65D 2401/25* (2020.05); *B65D 2543/00194* (2013.01); *B65D 2575/368* (2013.01)

(58) Field of Classification Search
CPC ..... B65D 77/2032; B65D 77/2088; B65D 2401/25; B65D 2251/0021; B65D 2251/0093; B65D 2543/00194; B65D 2575/368; B65B 11/52
USPC ..... 206/461–463, 468, 532
See application file for complete search history.

(56) References Cited

U.S. PATENT DOCUMENTS

| | | | | |
|---|---|---|---|---|
| 4,491,161 | A | 1/1985 | Tamura et al. | |
| 5,269,404 | A | 12/1993 | Wischusen, III et al. | |
| 5,297,679 | A * | 3/1994 | Rondone | B65D 73/0092 206/467 |
| 6,997,320 | B1 | 2/2006 | Kancsar et al. | |
| 8,727,205 | B2 * | 5/2014 | Wipf | B65D 5/38 229/122 |
| 9,701,449 | B2 * | 7/2017 | Jacobus | B65D 43/12 |
| 2010/0065459 | A1 * | 3/2010 | Tsao | B65D 75/327 206/470 |
| 2012/0043323 | A1 | 2/2012 | Thomas et al. | |

FOREIGN PATENT DOCUMENTS

| | | | |
|---|---|---|---|
| GB | 1384547 | A | 2/1975 |
| GB | 2085844 | A | 5/1982 |
| JP | S62025665 | U | 2/1987 |
| JP | H07172464 | A | 7/1995 |
| JP | H10505567 | A | 6/1998 |
| JP | 2001-046469 | A | 2/2001 |
| JP | 2004-149139 | A | 5/2004 |
| JP | 2006-168760 | A | 6/2006 |
| JP | 2009-062080 | A | 3/2009 |
| WO | WO-97/02192 | A1 | 1/1997 |
| WO | WO-2016/166240 | A1 | 10/2016 |
| WO | WO-2019/065734 | A1 | 4/2019 |

* cited by examiner

PACK PROVIDED WITH AT LEAST ONE BLISTER OPENABLE BY MEANS OF SLIDING

CROSS-REFERENCE TO RELATED APPLICATIONS

This patent application is a U.S. national phase of International Patent Application No. PCT/IB2021/057371 filed Aug. 10, 2021, which claims the benefit of priority from Italian patent application no. 102020000019879 filed on Aug. 10, 2020, the respective disclosures of which are each incorporated herein by reference in their entireties.

TECHNICAL FIELD

The present invention relates to a pack provided with at least one blister openable by means of sliding.

PRIOR ART

Blister is a term used for different types of pre-built plastic packs used as containers for small items. The two main components of the blister are a pocket that contains the product and is made of a sufficiently deformable material such as plastic or aluminum, and a closing tab made of paper, plastic or aluminum that can be broken through, which is glued or welded to a flat edge of the pocket. The blister opens (definitively, i.e., without the possibility of being closed again) by pressing against the deformable pocket with a finger: the pressure, exerted by the finger and transmitted by means of the product, on the closing tab breaks through the closing tab, thus allowing the product to emerge.

The fact of having to transmit pressure from the deformable cavity to the closing tab by means of the product makes it impossible to pack products in blister packs that are not sufficiently rigid, such as powders, liquids, and in general "soft" products. A possible solution is to close the pocket by means of an adhesive closing tab that must be gripped and pulled by the user to gradually detach the same from the cavity; that is, the closing tab is not broken but is progressively detached as it is connected to the flat edge of the pocket by means of a relatively weak adhesive. However, the use of an adhesive closing tab always requires the use of two hands for opening and above all requires the identification and grip of the lifting flap of the adhesive closing tab; the identification and grip of the lifting flap of the adhesive closing tab are operations that require good eyesight and good neuromotor coordination as the lifting flap of the adhesive closing tab cannot be very large so as to prevent, during the handling of the blister, some external object from becoming stuck thus causing an involuntary and unwanted opening of the blister.

The patent U.S. Pat. No. 5,269,404A discloses a sleeve and tray assembly having a flexible film attached to the tray and to the sleeve so that the insertion of the tray into the sleeve places the film in a position covering an access opening of the tray.

The patent application WO2019065734A1 discloses a container for electronic components comprising a main body having a plurality of concave storage portions open on one side and which serve to store electronic components, a lid covering the openings of the concave storage portions, and a covering sheet interposed between the main body and the lid.

DESCRIPTION OF THE INVENTION

The object of the present invention is to provide a pack provided with at least one blister openable by means of sliding which is designed to contain "soft" products, both easy and quick to open, and, at the same time, is (sufficiently) free from the risk of involuntary and unwanted openings.

According to the present invention, a pack, which is provided with at least one blister openable by means of sliding, is provided according to what is claimed in the attached claims.

The claims describe embodiments of the present invention forming an integral part of the present description.

BRIEF DESCRIPTION OF THE DRAWINGS

The present invention will now be described with reference to the attached drawings, which illustrate some non-limiting embodiment examples thereof, wherein.

PREFERRED EMBODIMENTS OF THE INVENTION

Figure 1:
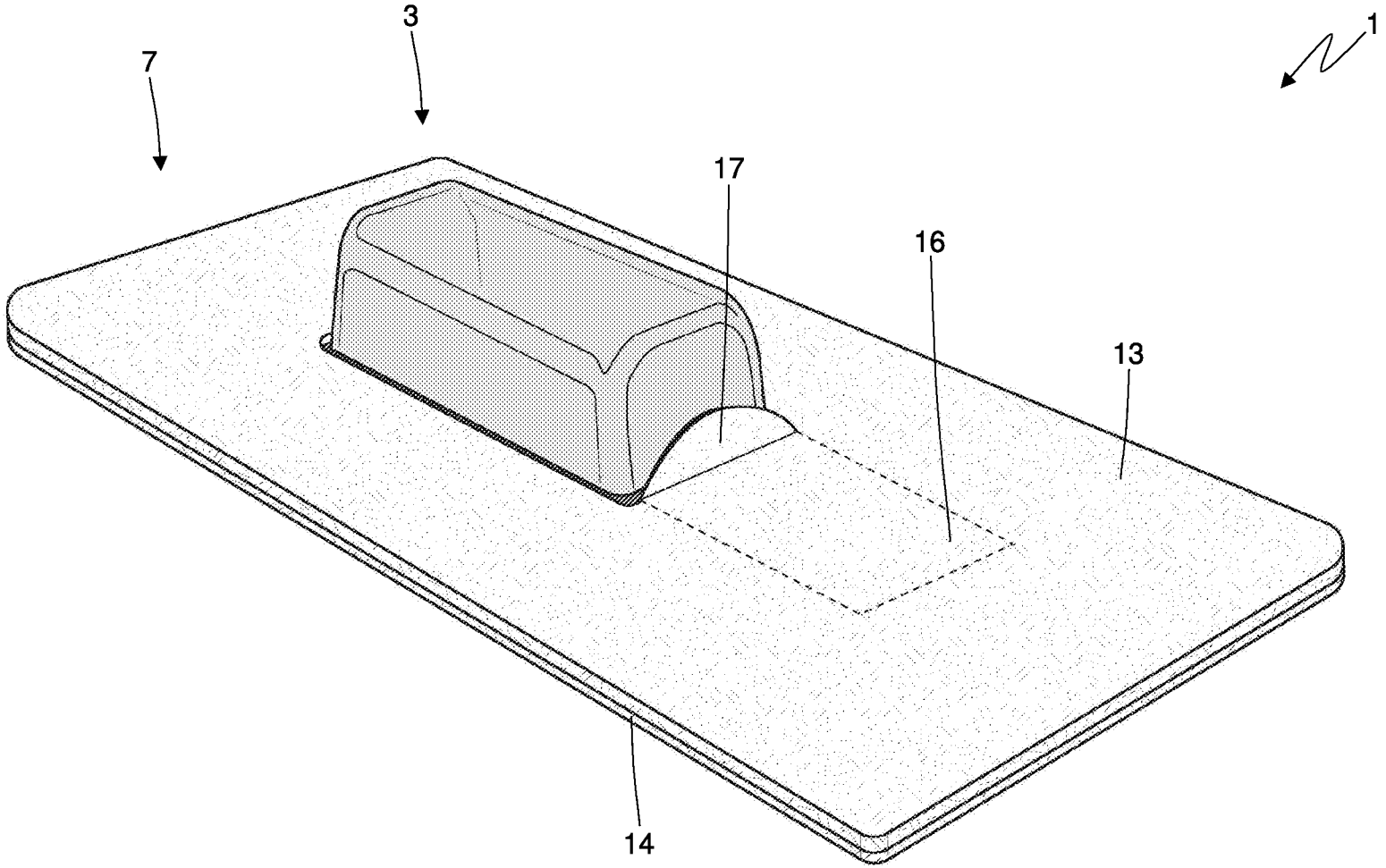
FIG. 1 is a perspective view and in a closing configuration of a pack provided with a blister.
Figure 2:
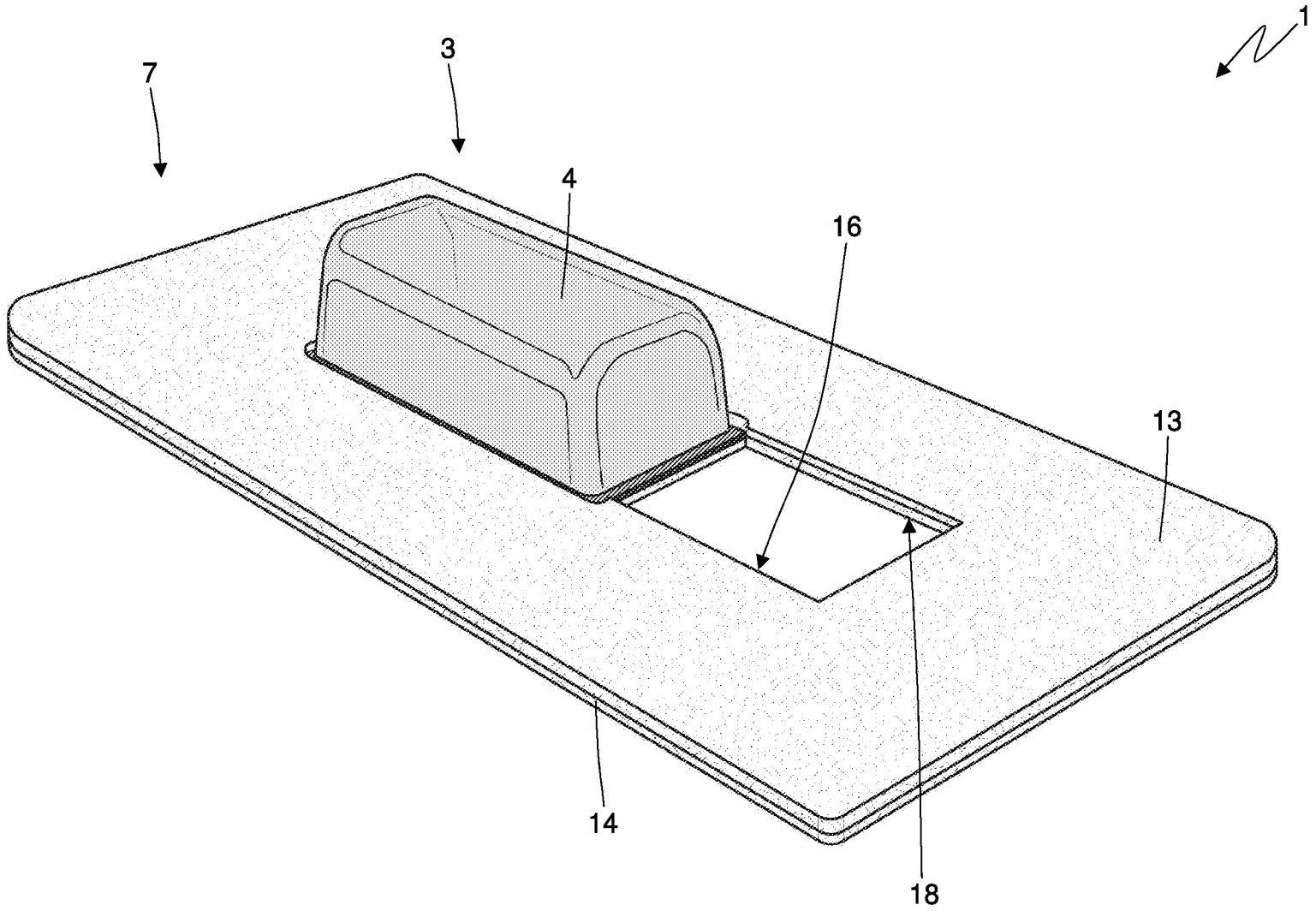
FIG. 2 is a perspective view and in a closing configuration of the pack of FIG. 1 after the removal of a locking element.
Figure 3:
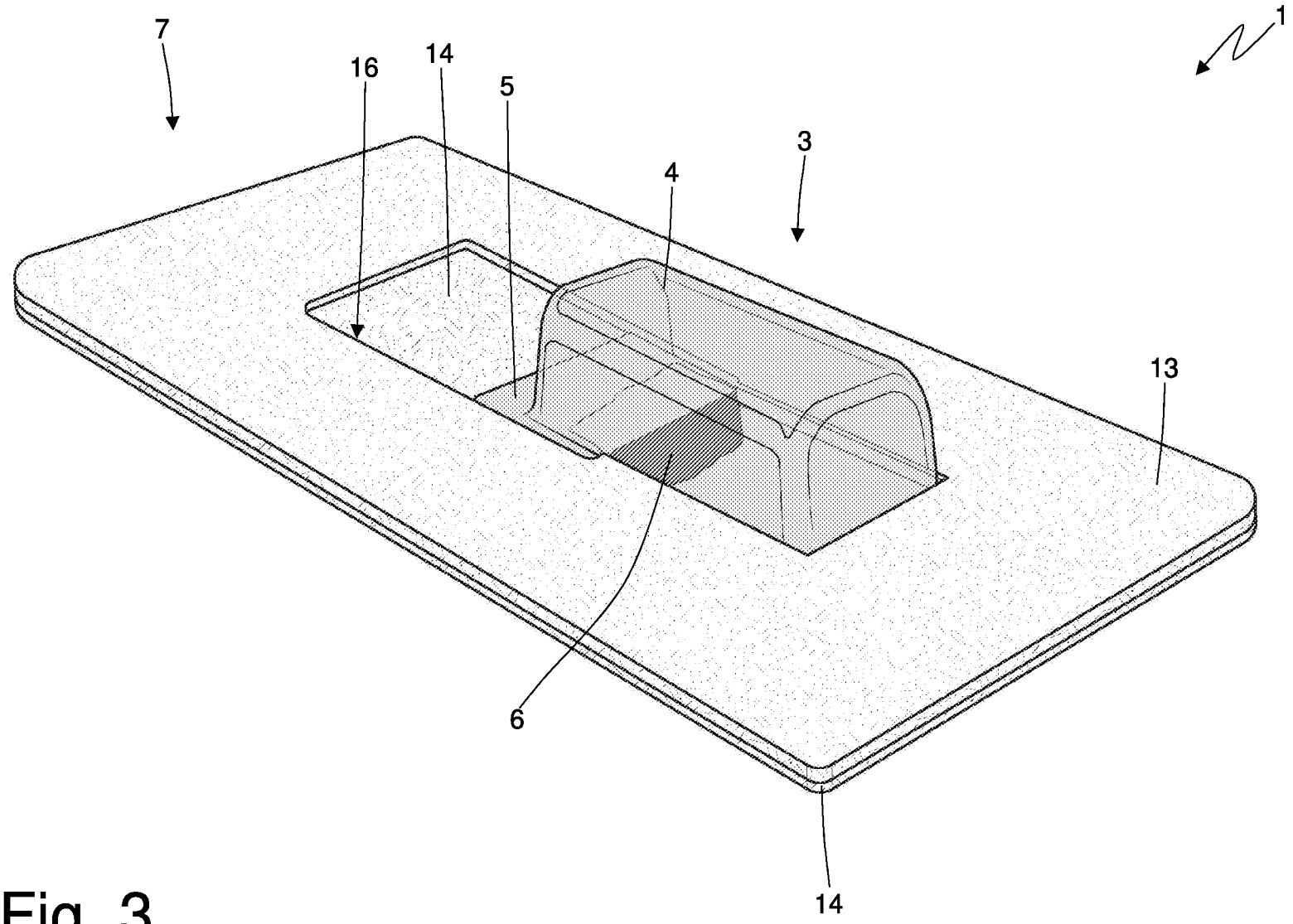
FIG. 3 is a perspective view and in an extraction configuration of the pack of FIG. 1.

In FIGS. 1, 2 and 3 number 1 denotes as a whole a pack 1 containing a product 2 (which is schematically illustrated in FIGS. 4-8 and could be, for example, a product of the tobacco industry such as a refill for a new generation smokeless cigarette). As further examples, the product 2 could be a product of the traditional tobacco industry and the like, of the pharmaceutical industry or, of the food industry, in particular confectionery.

Figure 10:
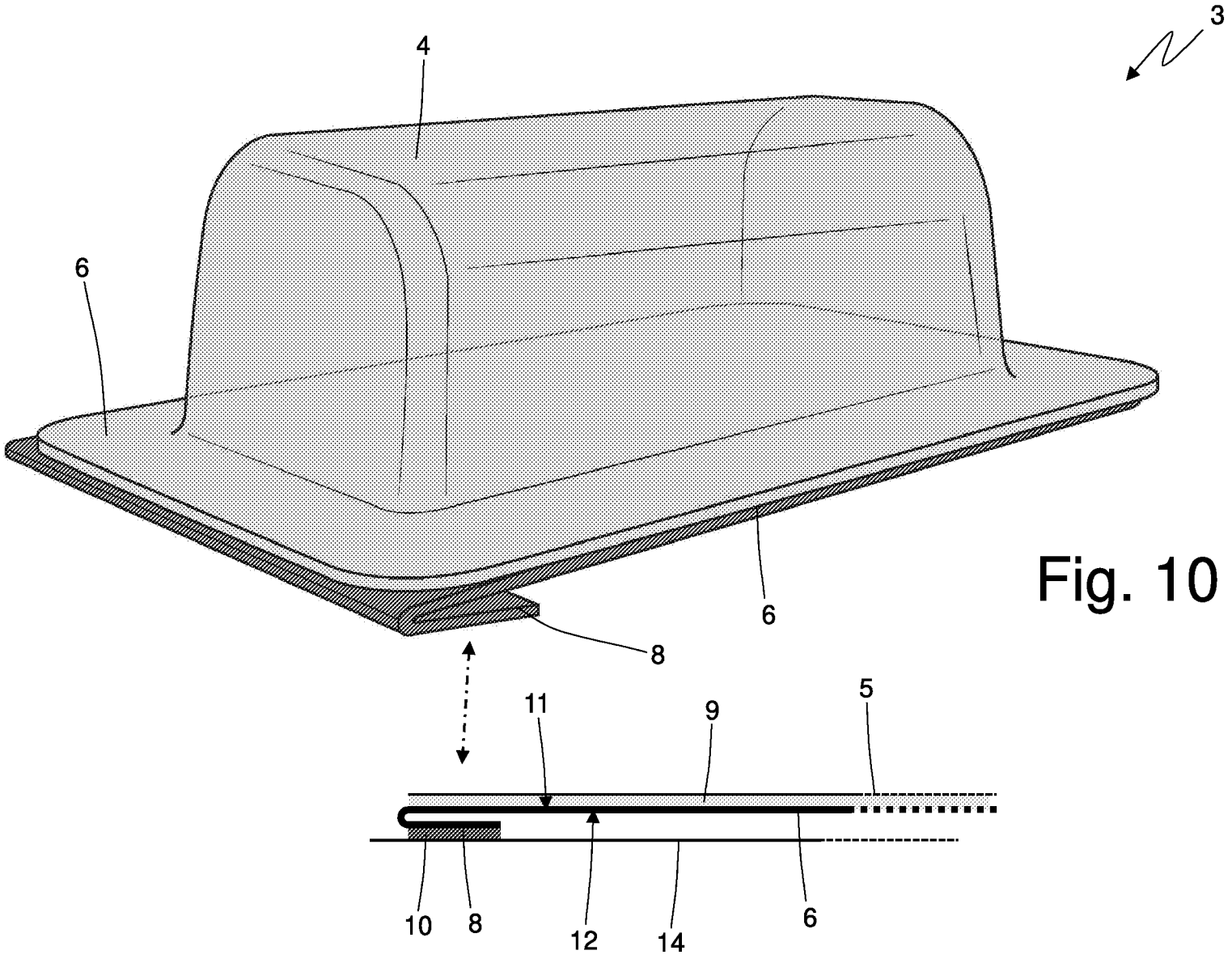
FIG. 10 is a perspective view of a blister of the pack of FIG. 1.

The pack 1 comprises a blister 3 which houses the product 2 on the inside thereof; according to what is better illustrated in FIG. 10, the blister 3 comprises a pocket 4 (i.e., a cup-shaped body open on one side) which houses the product 2 on the inside thereof; and has an open end surrounded by a flat edge 5. Furthermore, according to what is better illustrated in FIG. 10, the blister 3 also comprises a closing tab 6 which is connected to the flat edge 5 of the pocket 4 to close the open end thus keeping the product 2 inside the pocket 4.

In the embodiment illustrated in the attached figures, the pocket 4 has an approximately parallelepiped shape (compared to a perfectly parallelepiped shape, the pocket 4 has rounded edges) and therefore the flat edge 5 has an approximately rectangular shape (compared to a perfectly rectangular shape the edge 5 has rounded edges). Obviously, the pocket 4 (consequently its flat edge 5) can have different configurations and shapes, for example: hemispherical, flat with a square section, rectangular section or others.

As illustrated in FIGS. 1, 2 and 3, the pack 1 comprises a support body 7 which houses the blister 3 in a sliding manner so as to allow the blister 3 to move relative to the support body 7 between a closing position (illustrated in FIGS. 1, 2, 5 and 6) in which it is not possible to extract the product 2 from the pocket 4 and an extraction position, (illustrated in FIGS. 3, 4 and 8) in which it is possible to extract the product 2 from the pocket 4.

Figure 7:
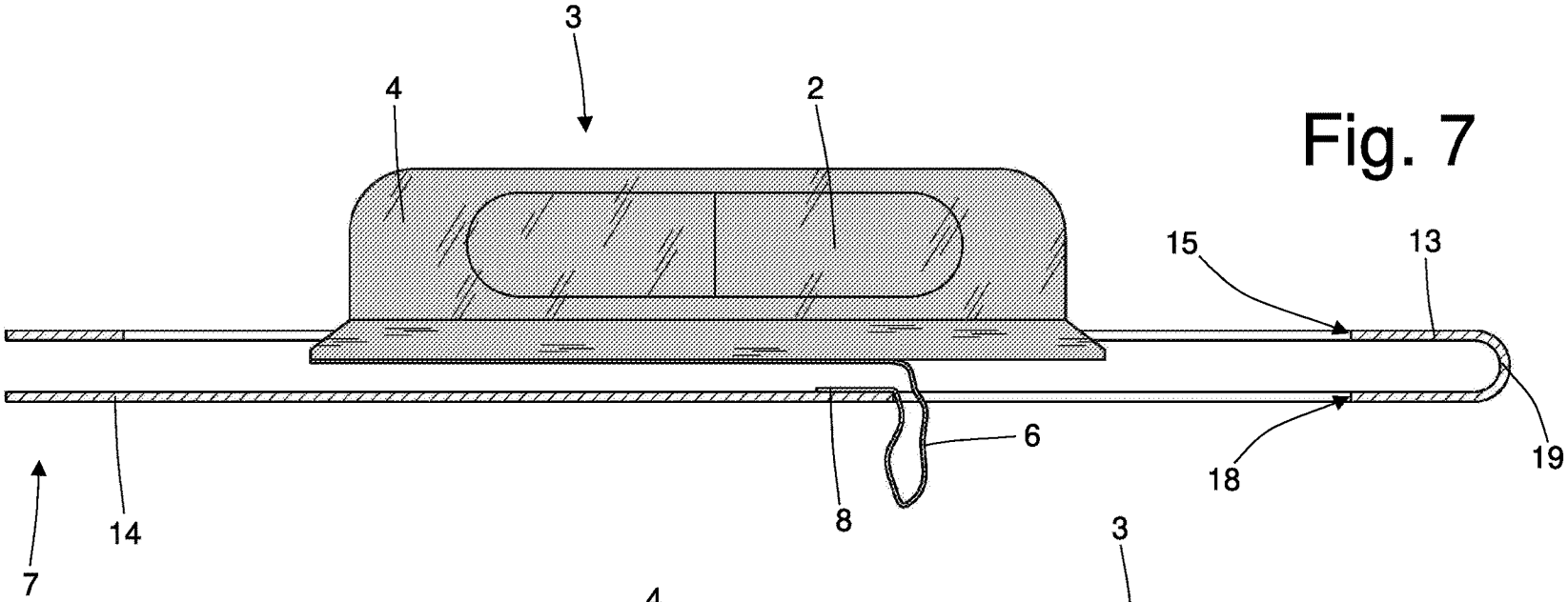
Figure 8:
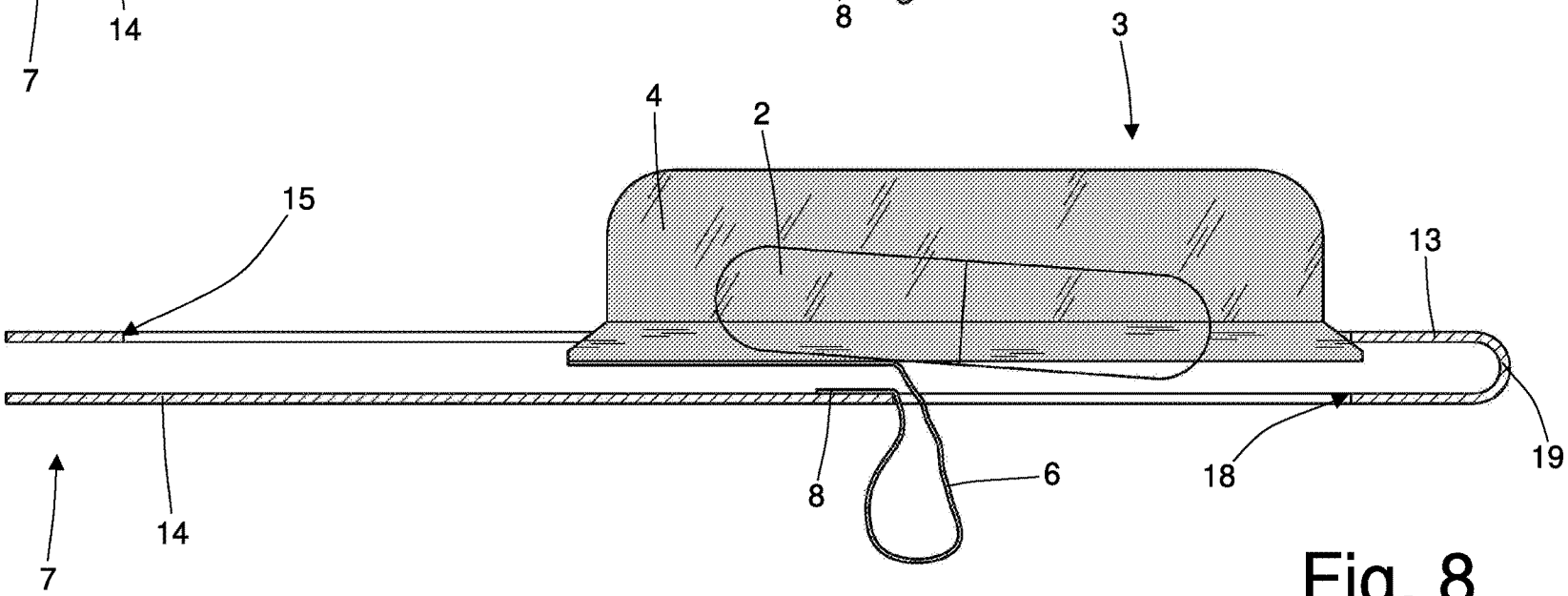

A connection end 8 of the closing tab 6 (better illustrated in FIGS. 5-8 and 10) is fixed to the support body 7 in a permanent and inseparable manner so that the sliding movement of the blister 3 relative to the support body 7 from the closing position (illustrated in FIGS. 1, 2, 5 and 6) to the extraction position (illustrated in FIGS. 3, 4 and 8) causes a progressive separation of the closing tab 6 from the flat edge 5 of the pocket 4 (as well illustrated in FIGS. 7 and 8). In other words, since the connection end 8 of the closing tab 6 is fixed to the support body 7 in a permanent and inseparable manner, as the blister 3 moves from the closing position (illustrated in FIGS. 1, 2, 5 and 6) to the extraction position (illustrated in FIGS. 3, 4 and 8) the connection end 8 remains stationary on the support body 7, forcing the rest of the closing tab 6 to gradually detach from the flat edge 5 of the pocket 4 which slides relative to the support body 7.

Figure 4:
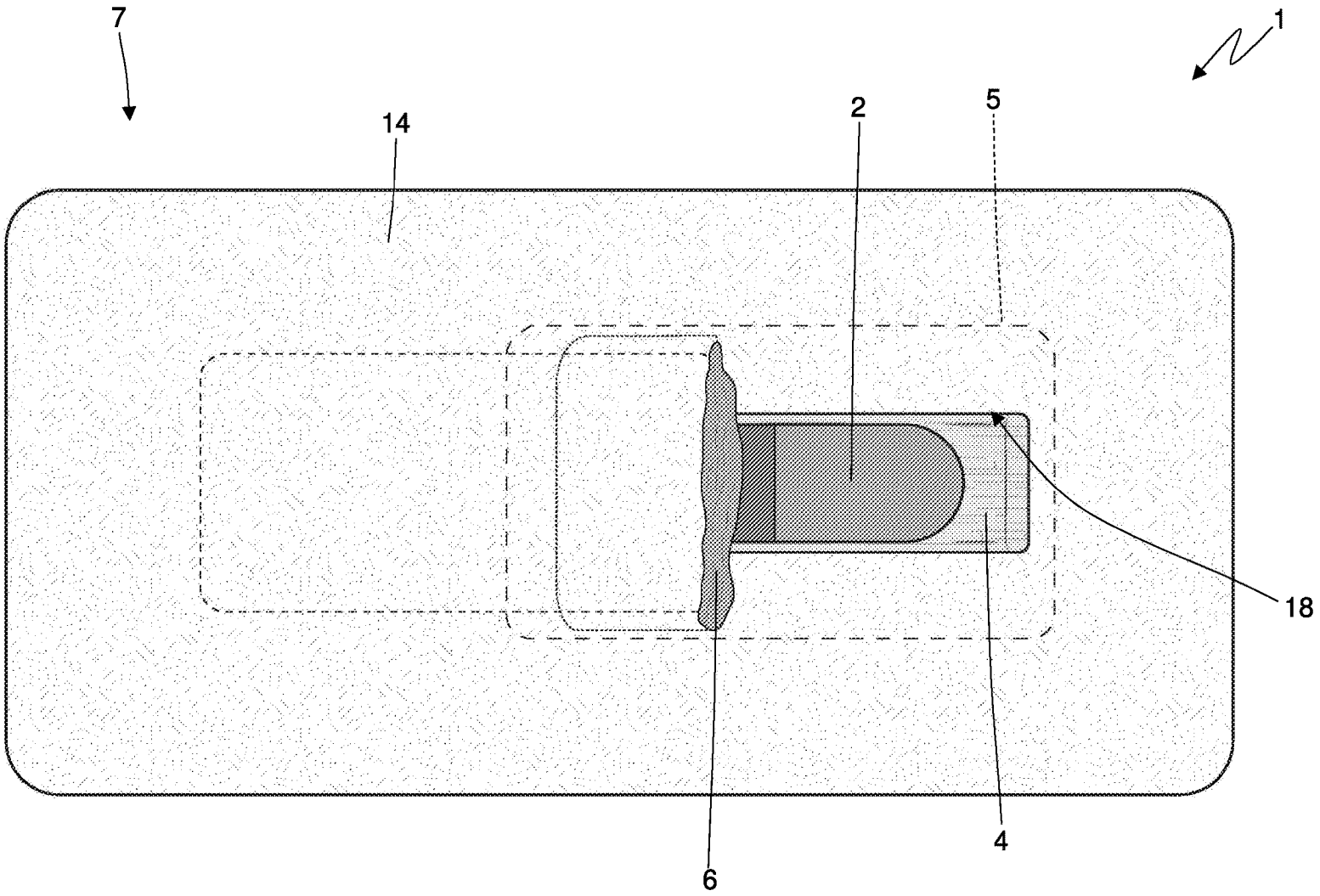
FIG. 4 is a bottom view and in an extraction configuration of the pack of FIG. 1.

In particular, the connection end 8 of the closing tab 6 is fixed to the support body 7 in a permanent and inseparable manner so that the closing tab 6 adheres completely to the flat edge 5 of the pocket 4 when the blister 3 is in the closing position (illustrated in FIGS. 1, 2, 5 and 6) and so that the closing tab 6 has the maximum deviation from the flat edge 5 of the pocket 4 when the blister 3 is in the extraction position (illustrated in FIGS. 3, 4 and 8). Consequently, when the blister 3 is in the closing position (illustrated in FIGS. 1, 2, 5 and 6), the connection end 8 of the closing tab 6 is in a front position relative to the sliding direction (i.e., the direction along which the blister 3 slides in order to move from the closing position to the extraction position).

It is important to note that the sliding movement of the blister 3 relative to the support body 7 from the extraction position (illustrated in FIGS. 3, 4 and 8) to the closing position (illustrated in FIGS. 1, 2, 5 and 6) causes a progressive re-coupling of the closing tab 6 to the flat edge 5 of the pocket 4; that is, the stripping (separation) process of the closing tab 6 from the flat edge 5 of the pocket 4 determined by the sliding of the blister 3 is reversible by sliding the blister 3 in the opposite direction.

As illustrated in FIG. 10, the closing tab 6 is connected to the flat edge 5 of the pocket 4 by means of a re-stick adhesive 9 (also called "stick & detach" adhesive) which does not dry and allows to join and detach the closing tab 6 to/from the flat edge 5 of the pocket 4 several times; then, thanks to the use of the re-stick adhesive 9, the pocket 4 can be opened (by moving the blister 3 from the closing position to the extraction position) and closed again in a sealed manner (by moving the blister 3 from the extraction position to the closing position). Alternatively, the adhesive 9, instead of being of the re-stick type, could be of the permanent type (i.e., which dries and must be broken to be separated in a way that cannot be reassembled) and relatively weak (to be broken during the sliding movement of the blister 3 without the need to apply excessive force on the blister 3).

As illustrated in FIG. 10, the closing tab 6 is connected to the support body 7 by means of a permanent adhesive 10 (i.e., which dries and must be broken in a non re-attachable manner in order to be separated) and relatively strong (because the support body 7 and closing tab 6 connection must never break in use).

As illustrated in FIG. 10, the closing tab 6 has an inner surface 11 facing the pocket 4 and an outer surface 12 facing the opposite side of the pocket 4. In the embodiment illustrated in the attached figures, the end part of the closing tab 6 at the connection end 8 is bent by 180° against the remaining part of the closing tab 6 so that a part of the inner surface 11 is fixed to the support body 7 in a permanent and inseparable manner (by using the permanent adhesive 10). Bending the connection end 8 by 180° against the remaining part of the closing tab 6 allows the opening stroke of the blister pack 3 to be reduced by a few millimeters. According to a different embodiment not illustrated, at the connection end 8 a part of the outer surface 12 of the closing tab 6 is fixed to the support body 7 in a permanent and inseparable manner (by means of the permanent adhesive 10).

Figure 9:
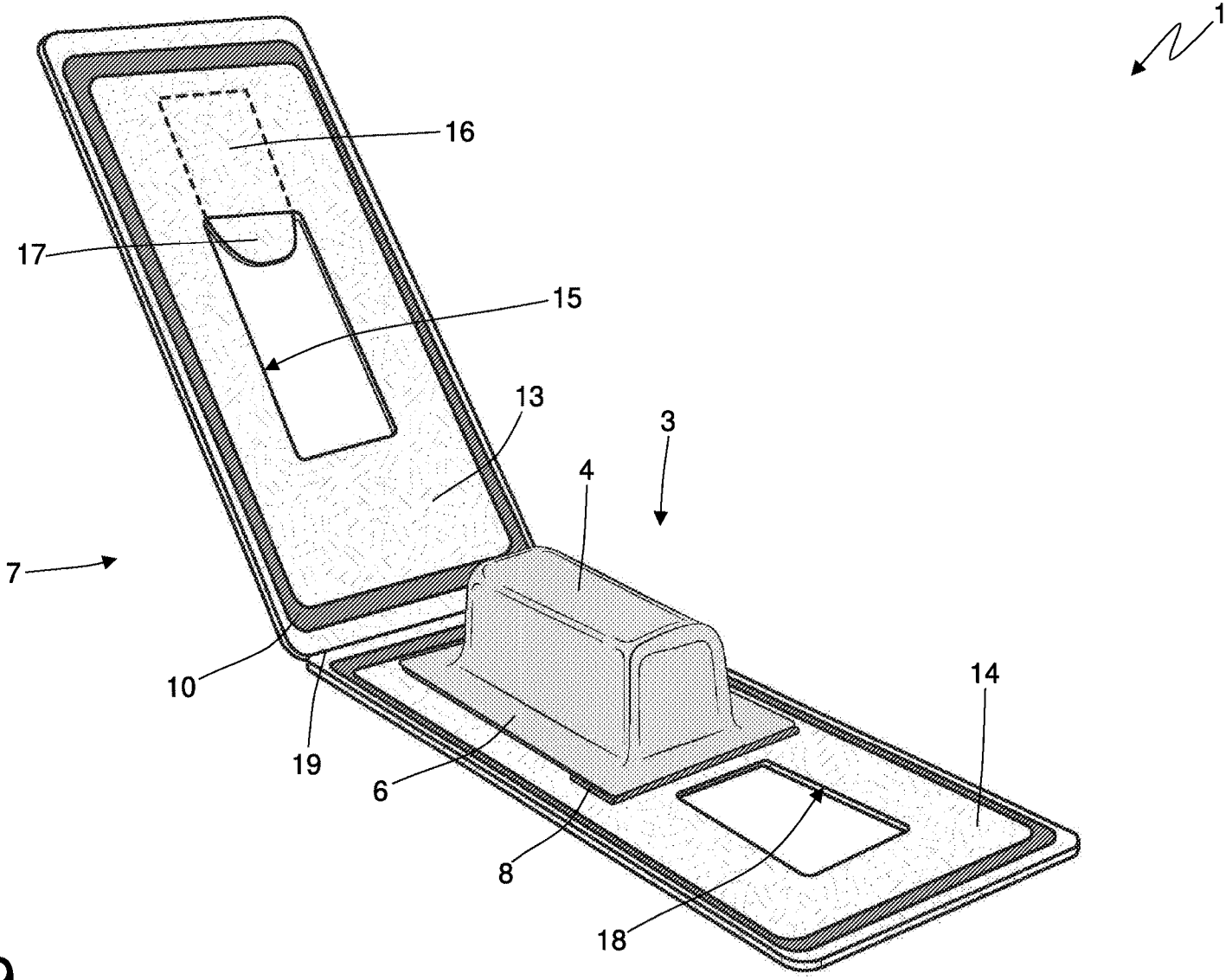
FIG. 9 is a perspective and partially exploded view of the pack of FIG. 1.

As better illustrated in FIG. 9, the support body 7 comprises an upper wall 13 and a lower wall 14 overlapping one another so as to define, between them, an inner space (better shown in FIGS. 5-8) partially occupied by the edge 5 of the pocket 4. The two walls 13 and 14 are glued to one another by means of the permanent adhesive 10, which is arranged around the entire area in which the blister 3 is located (in the various possible positions).

Figure 5:
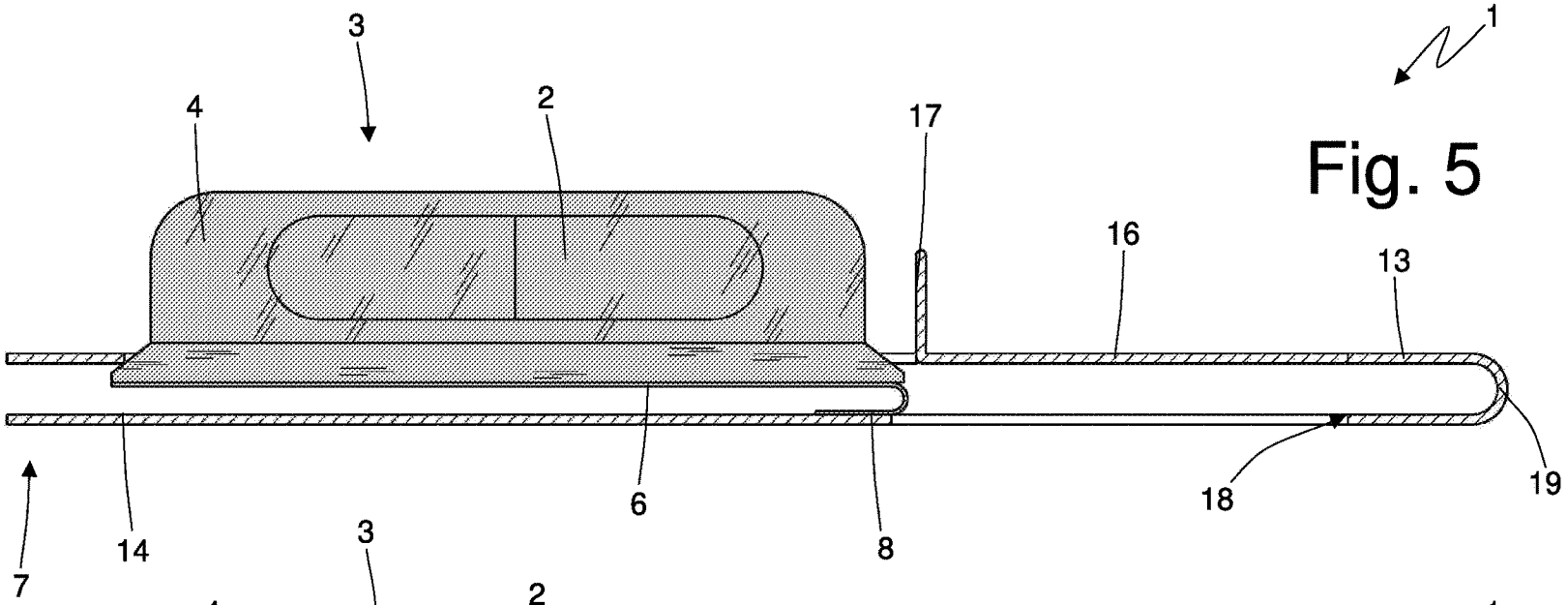
FIGS. 5-8 are schematic and side views of the pack of FIG. 1 in different configurations.
Figure 6:
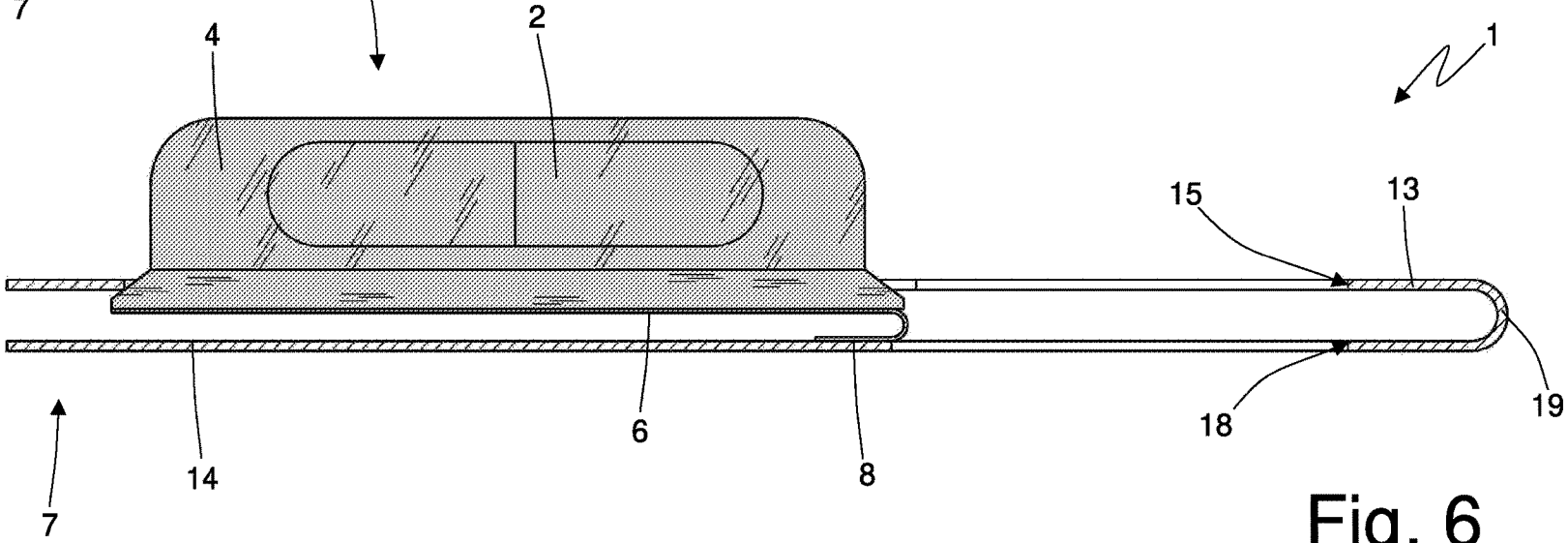

The upper wall 13 of the support body 7 has a through opening which is engaged by the pocket 4 and has a larger size than the pocket 4 in a sliding direction, so as to allow the blister 3 to slide between the closing position (illustrated in FIGS. 1, 2, 5 and 6) and the extraction position (illustrated in FIGS. 3, 4 and 8). According to a preferred embodiment, the upper wall 13 has a locking element 16 which engages the through opening 15 only at the extraction position, is removable by tearing, and must be removed to allow the blister 3 to slide from the closing position (illustrated in FIGS. 1, 2, 5 and 6) to the extraction position (illustrated in FIGS. 3, 4 and 8). In other words, the locking element 16 is connected to the rest of the upper wall 13 by means of pre-weakened tear-off lines which facilitate the tear-off removal of the locking element 16. According to a preferred embodiment, the locking element 16 has a grippable end 17 which is bent by 90° relative to the rest of the locking element 16 (as illustrated in FIGS. 1 and 5).

The lower wall 14 of the support body 7 has a through opening 18 which is present only at the extraction position (illustrated in FIGS. 3, 4 and 8) so as to expose the open end of the pocket 4 only when the blister 3 is in the extraction position (illustrated in FIGS. 3, 4 and 8). That is, when the blister 3 is in the closing position (illustrated in FIGS. 1, 2, 5 and 6) the open end of the pocket 4 is completely covered by the lower wall 14 of the support body 7 and therefore is not accessible from the outside (regardless of the presence of the closing tab 6); only when the blister 3 moves to the extraction position (illustrated in FIGS. 3, 4 and 8), then the open end of the pocket 4 becomes accessible from the outside through the through opening 18 of the lower wall 14 of the support body 7.

Figure 11:
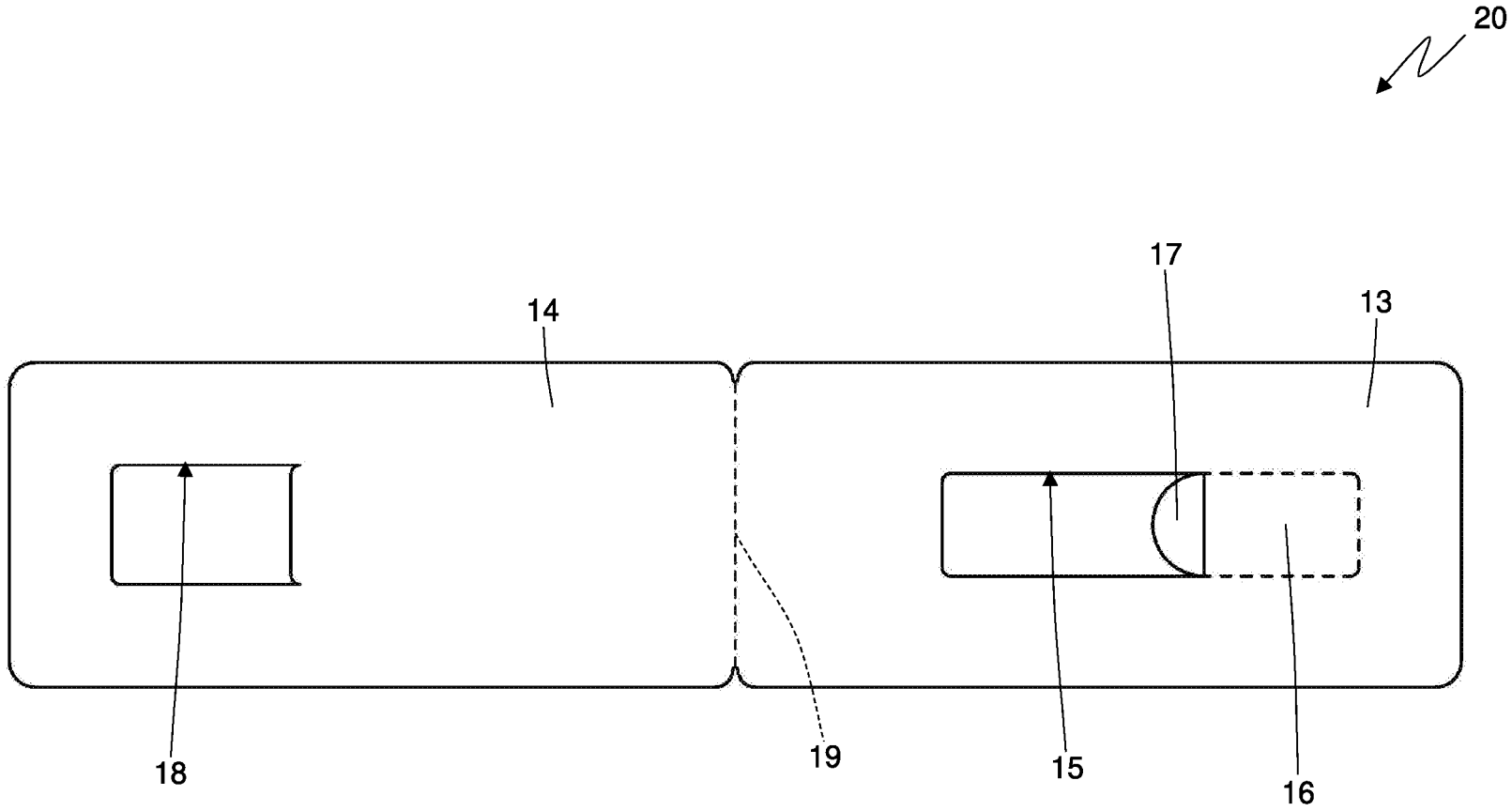
FIG. 11 is a plan view of a blank used to make a support body for the pack of FIG. 1.

According to a preferred embodiment, the upper wall 13 and the lower wall 14 of the support body 7 are connected to one another by means of a hinge 19; consequently, the support body 7 is formed by folding a flat blank 20 (illustrated in FIG. 11) formed by the two walls 12 and 13, which are hinged to one another by means of the hinge 19 (which forms a pre-weakened folding line).

According to a possible alternative not illustrated, the support body 7 comprises an intermediate wall which is arranged between the upper wall 13 and the lower wall 14 (i.e., on one side it is glued to the upper wall 13 and on the opposite side it is glued to the lower wall 14) and has, at the center, a through opening which delimits the movement area of the blister 3. Preferably, the intermediate wall of the support body 7 is hinged to the upper wall 13 or to the lower wall 14 to be bent by 180° against the upper wall 13 or against the lower wall 14 during the manufacturing of the pack 1. The function of the intermediate wall of the support body 7 is to define the movement of the blister 3 in a more secure and precise way, since the intermediate wall forms an actual track inside of which the blister 3 is boxed.

The size of the access area of the pocket 4 that is formed when the blister 3 arrives in the extraction position (illustrated in FIGS. 3, 4 and 8) depends upon the length of the stroke of the blister 3 between the closing position (illustrated in FIGS. 1, 2, 5 and 6) and the extraction position (illustrated in FIGS. 3, 4 and 8); i.e., the longer the stroke length of the blister 3 between the closing position (illustrated in FIGS. 1, 2, 5 and 6) and the extraction position (illustrated in FIGS. 3, 4 and 8), the greater the dimension of the access area of the pocket 4, which is formed when the blister 3 arrives in the extraction position (illustrated in FIGS. 3, 4 and 8). During the design phase, it is possible to choose a more or less extended through opening 15 of the upper wall 13 (therefore a more or less extended stroke of the blister 3) to have a more or less large access area to the pocket 4; obviously, the size of the access area to the pocket 4 is chosen in relation to the type of product 2 contained inside the pocket 4 (for example a larger product 2 needs a larger access area to the pocket 4 while a light and inconsistent product 2 recommends a smaller access area to the pocket 4 in order to avoid involuntary and uncontrolled spilling).

To manufacture the pack 1, the blister 3 is initially obtained (in a known manner) provided with the pocket 4 housing the product 2 and the closing tab 6. Subsequently, a flat blank 20 is provided, formed by the lower wall 14 and by the upper wall 13, which are hinged to one another; on the blank 20, and in particular on the lower wall 14 of the flat blank 20, the permanent adhesive 10 is applied. At this point the blister 3 is placed on the lower wall 14 of the blank 20 (causing the gluing of the connection end 8 of the closing tab 6 to the lower wall 14 due to the presence of the permanent adhesive 10) and then the upper wall 13 it is bent relative to the lower wall 14 so as to cause the upper wall 13 to come into contact with the lower wall 14 by making the pocket 4 pass through the through opening 15 of the upper wall 13; in this operation, the pocket 4 causes the bending by 90° of the grippable end 17 of the locking element 16 as it passes through the through opening 15 of the upper wall 13.

The wrapping (production) steps described above are generally implemented in an automatic packing machine.

In FIGS. 1-11, the sliding direction of the blister 3 is oriented longitudinally relative to the blister 3; that is, the sliding direction of the blister 3 is parallel to the longer sides of the blister 3 (i.e., it is perpendicular to the shorter sides of the blister 3).

Figure 12:
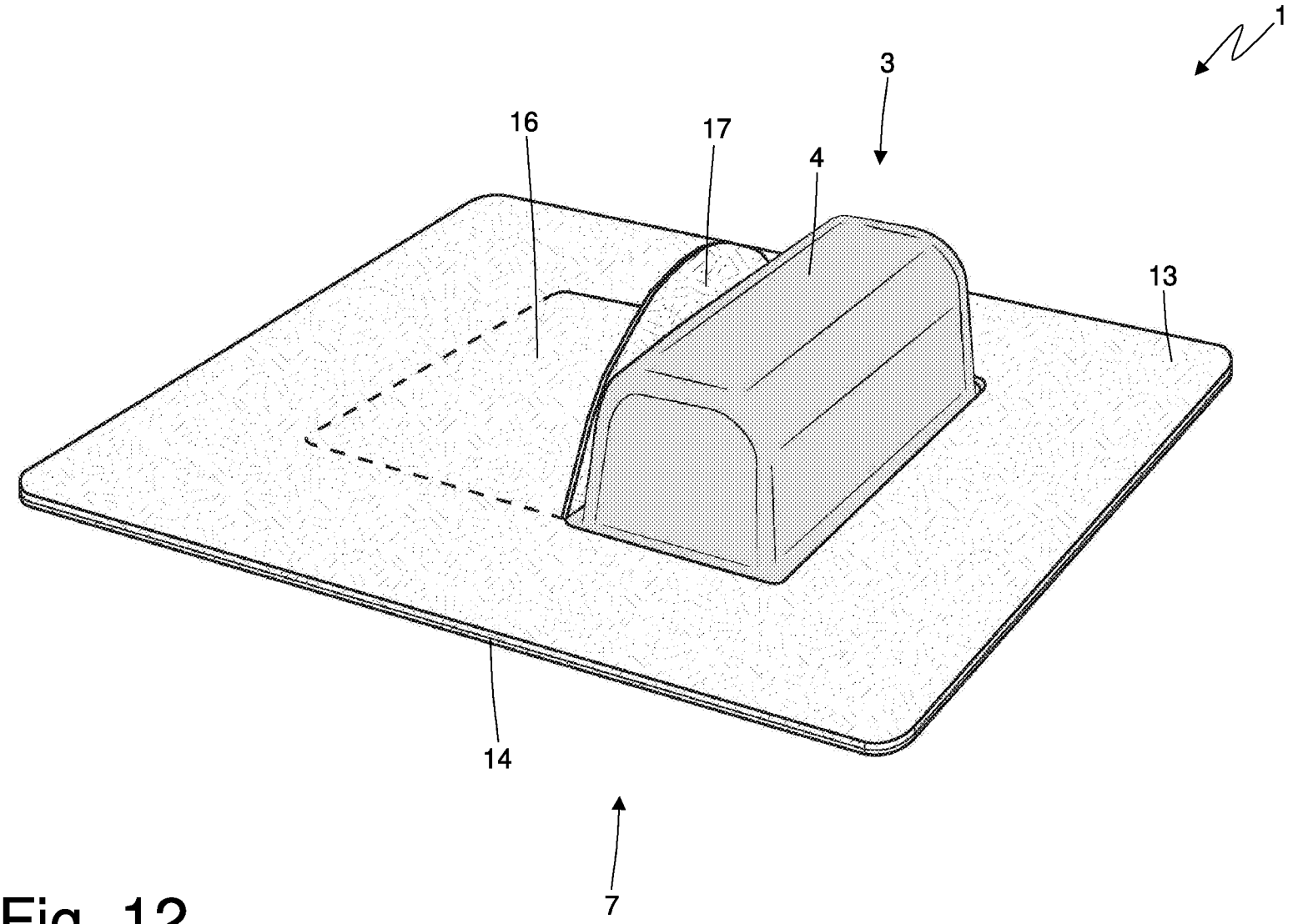
FIG. 12 is a perspective view and in a closing configuration of an alternative of the pack of FIG. 1.
Figure 13:
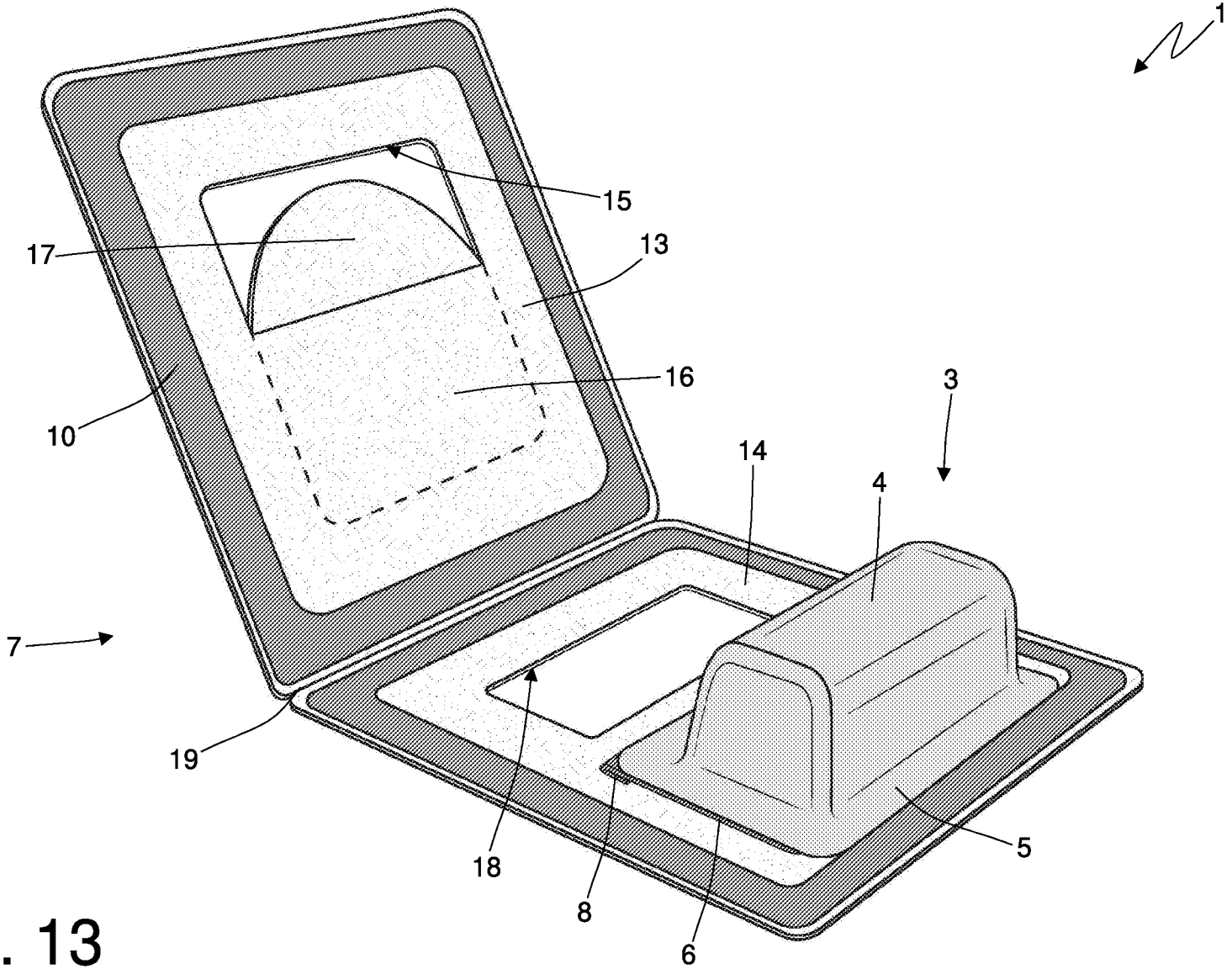
FIG. 13 is a perspective and partially exploded view of the pack of FIG. 12.
Figure 14:
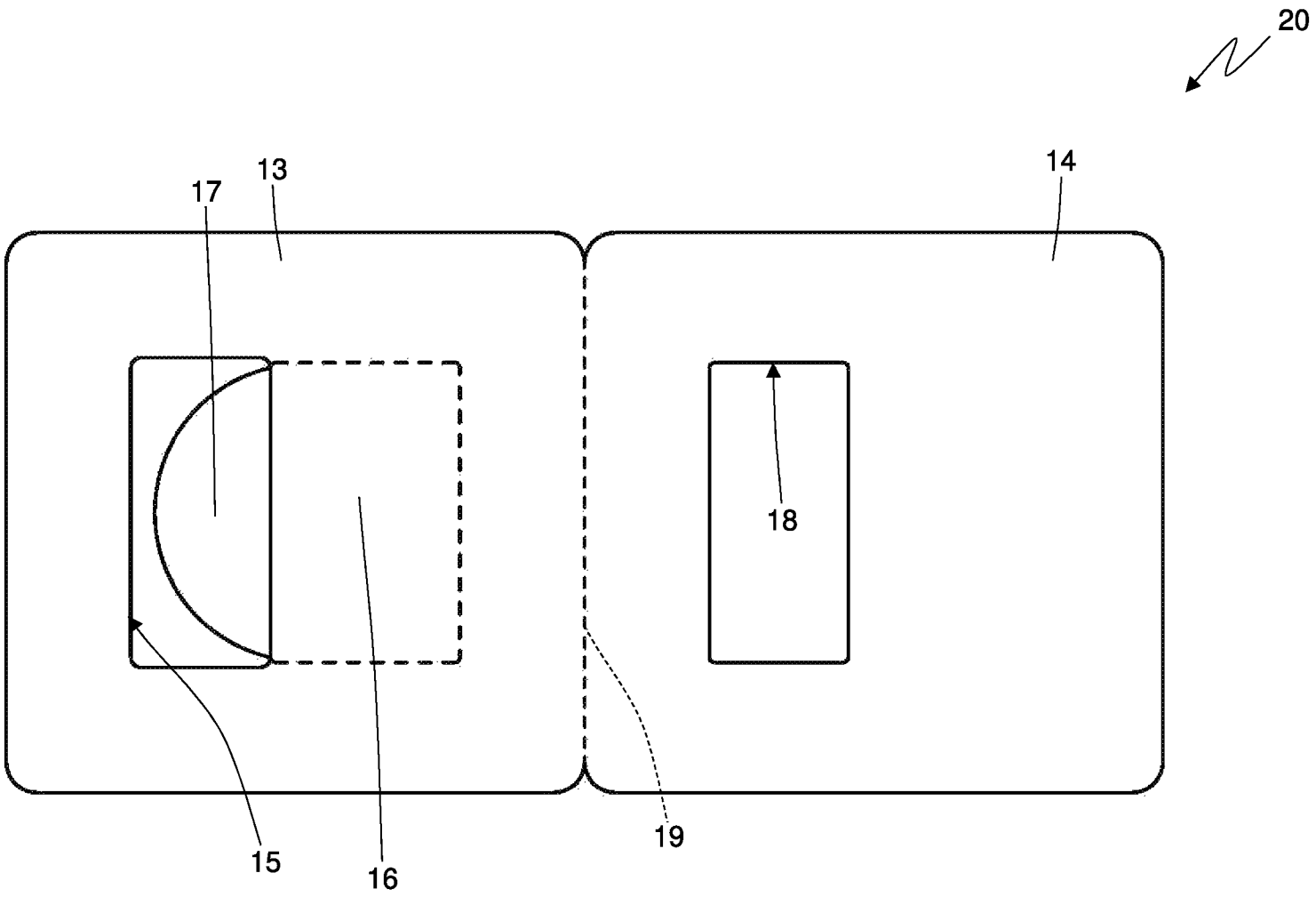
FIG. 14 is a plan view of a blank used to obtain a support body for the pack of FIG. 12.

In the alternative illustrated in FIGS. 12-14, the sliding direction of the blister 3 is oriented transversely relative to the blister 3; that is, the sliding direction of the blister 3 is parallel to the shorter sides of the blister 3 (i.e., it is perpendicular to the longer sides of the blister 3).

Figure 15:
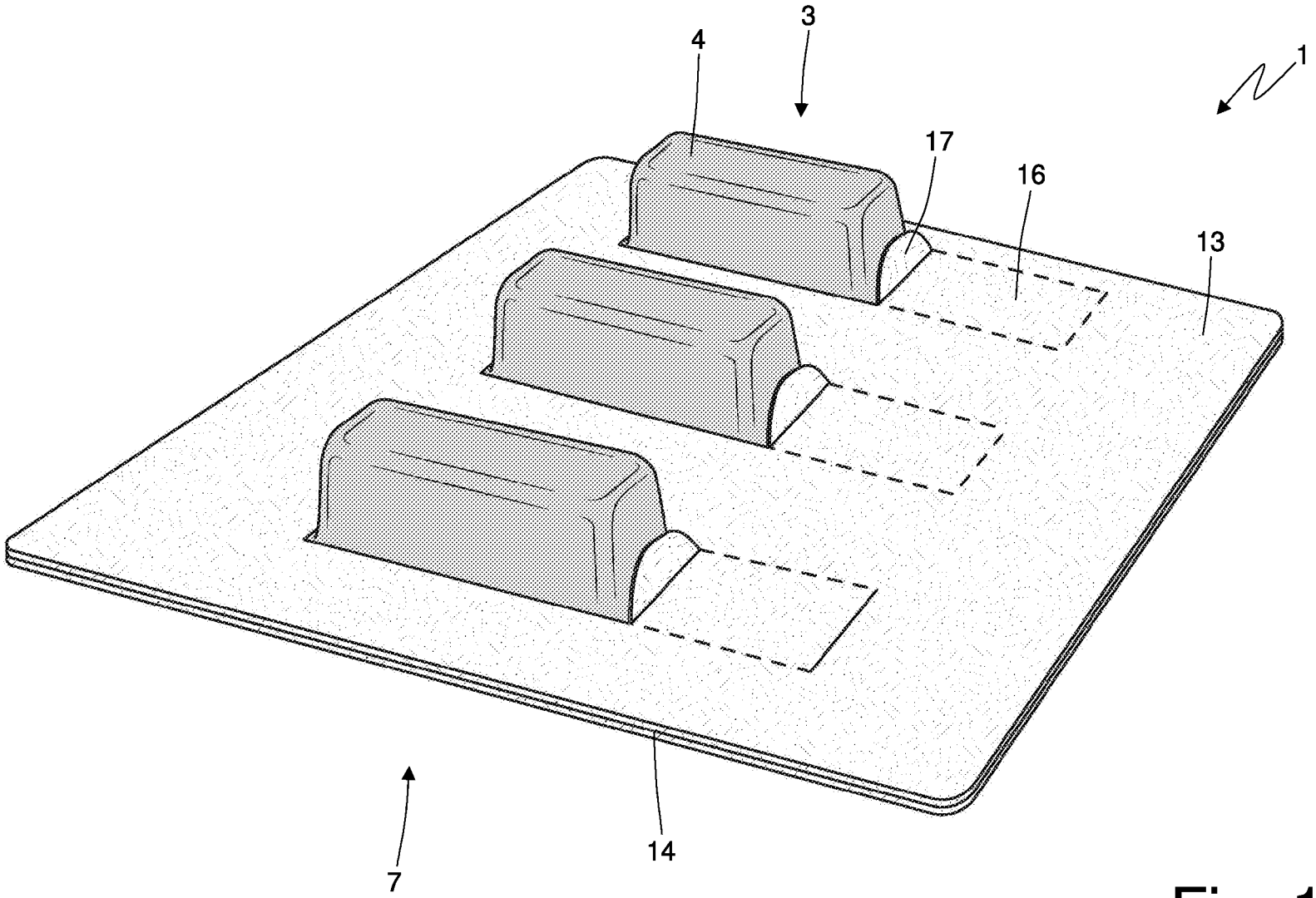
FIG. 15 is a perspective view and in a closing configuration of another alternative of the pack of FIG. 1.
Figure 16:
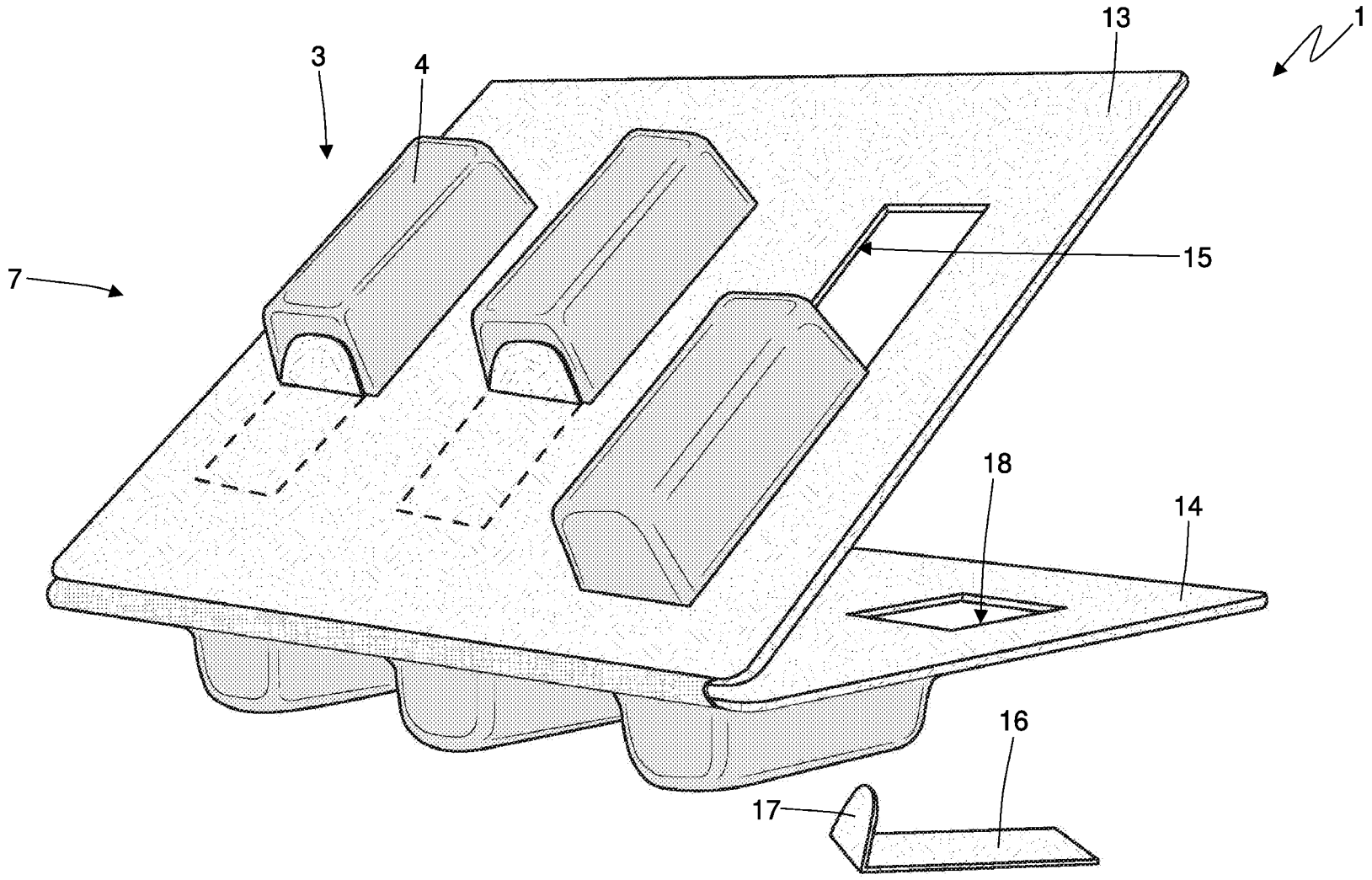
FIG. 16 is a perspective view partly in an extraction configuration and partly in a closing configuration of a further alternative of the pack of FIG. 1.

In FIGS. 1-14, the pack 1 comprises a single blister 3 (and therefore houses a single product 2). In the alternative illustrated in FIG. 15, the pack 1 comprises a plurality of blisters 3, which are arranged parallel and alongside one another; in FIG. 15 three blisters 3 are illustrated but obviously the number of blisters 3 could be different. In the alternative illustrated in FIG. 16, the pack 1 comprises a first group of blisters 3, which are arranged parallel and alongside one another on a first side of the support body 7 and a second group of blisters 3, which are arranged parallel and alongside one another on a second side of the support body 7; the two sides of the support body 7 are hinged to one another. In FIG. 16 groups each having three blisters 3 are illustrated, but obviously the number of blisters 3 could be different.

A single product 2 could be contained in the same blister 3 (i.e., in the pocket 4 of the same blister 3); alternatively, two or more products 2 could be contained in the same blister 3 (i.e., in a pocket 4 of the same blister 3). That is, a single product 2 or a plurality of products 2, arranged in contact with one another, could be contained in the pocket 4 of a blister 3. When two or more products 2 are contained in the same blister 3, the possibility of reclosing the blister 3 after opening it is particularly useful so as to allow only one product 2 to be removed at a time, leaving the other products 2 safe in the closed blister 3. The presence of several products 2 in the same blister 3 (i.e., in the pocket 4 of the same blister 3) is relatively frequent in the smoking article industry (i.e., of the tobacco industry). In other words, in the same blister 3 (i.e., in the pocket 4 of the same blister 3) several products 2 of the smoking article industry (i.e., of the tobacco industry) can be provided.

Obviously, the product 2 contained in a blister 3 can be of any type: a component for smoking articles (such as, for example, a refill for a new generation smokeless cigarette, loose tobacco for rolling cigarettes), medicine (also in powder or liquid form), ear plugs, products of the confectionery industry.

The embodiments described herein can be combined with each other without departing from the scope of the present invention.

The pack 1 described above has numerous advantages.

Firstly, the pack 1 described above is designed to contain "soft" products 2, as the extraction of the products 2 does not require exerting any pressure on the products 2.

Furthermore, the pack 1 described above is extremely simple, ergonomic and intuitive to open (which can also be done using only one hand) as it is sufficient to push with a non-excessive force on the blister 3 to move the same from the closing position (illustrated in the FIGS. 1, 2, 5 and 6) to the extraction position (illustrated in FIGS. 3, 4 and 8).

The pack 1 described above can also be easily and effectively reclosed by moving the blister 3 from the extraction position (illustrated in FIGS. 3, 4 and 8) to the closing position (illustrated in FIGS. 1, 2, 5 and 6). Closing the blister 3 after the extraction of the product 2 can be very advantageous, as it allows to prevent residues of the product 2 (particularly when the product 2 is liquid or powder) from accidentally spilling and as it allows to put the exhausted product 2 back into the blister 3 (i.e., it provides a place to store the exhausted product 2 until its correct disposal). Furthermore, the possibility of closing the blister 3 after the extraction of a product 2 is very useful when more products 2 are provided in the same blister 3: the user can open the blister 3 to take only one product 2 at a time, leaving inside the blister 3 the other products 2 to be removed later and therefore it is extremely convenient to be able to close the blister 3.

The pack 1 described above, thanks to the presence of the locking element 16, which must be removed by tearing at the first opening, also allows to check its integrity, i.e., it allows to verify that it has never been opened before. In other words, the locking element 16 constitutes a guarantee seal of the integrity of the pack 1 described above.

The pack 1 described above, also, but not only, thanks to the presence of the locking element 16 which must be removed by tearing at the first opening, is completely free from the risk of involuntary and unwanted opening. In fact, even in the absence of the locking element 16, an involuntary and undesired opening of the pack 1 described above is very unlikely since it is extremely difficult for a force with the correct intensity and the correct direction to be accidentally applied onto the blister 3 to move the blister 3 from the closing position (illustrated in FIGS. 1, 2, 5 and 6) towards the extraction position (illustrated in FIGS. 3, 4 and 8).

LIST OF REFERENCE NUMBERS OF THE FIGURES

1 pack
2 product
3 blisters
4 pocket
5 edge
6 closing tab
7 support body
8 connection end
9 re-stick adhesive
10 permanent adhesive
11 inner surface
12 outer surface
13 upper wall
14 lower wall
15 through opening
16 locking element
17 grippable end
18 through opening
19 hinge
20 blank

The invention claimed is:

1. A pack (1) comprising:

at least one product (2);

a blister (3) provided with a pocket (4), which houses the at least one product (2) and has an open end surrounded by a flat edge (5), and provided with a closing tab (6), which is connected to the flat edge (5) of the pocket (4) in order to close the open end; and a support body (7), which houses the blister (3) in a sliding manner so as to allow the blister (3) to move relative to the support body (7) between a closing position, in which the at least one product (2) cannot be removed from the pocket (4), and an extraction position, in which the at least one product (2) can be removed from the pocket (4);

wherein a connection end (8) of the closing tab (6) is fixed to the support body (7) in a permanent and inseparable manner so that the sliding movement of the blister (3) relative to the support body (7) from the closing position to the extraction position causes a progressive separation of the closing tab (6) from the flat edge (5) of the pocket (4);

wherein the support body (7) comprises an upper wall (13) and a lower wall (14) overlapping one another so as to define, between them, an inner space which is partially occupied by the edge (5) of the pocket (4);

wherein the upper wall (13) has a first through opening (15), which is engaged by the pocket (4) and has a larger size than the pocket (4) in a sliding direction, so as to allow the blister (3) to slide between the closing position and the extraction position.

2. The pack (1) according to claim 1, wherein the sliding movement of the blister (3) relative to the support body (7) from the extraction position to the closing position causes the closing tab (6) to be progressively coupled again to the flat edge (5) of the pocket (4).

3. The pack (1) according to claim 1, wherein the closing tab (6) is connected to the flat edge (5) of the pocket (4) by means of a re-stick adhesive (9).

4. The pack (1) according to claim 1, wherein:

the closing tab (6) has an inner surface (11) facing the pocket (4) and an outer surface (12) facing away from the pocket (4); and an end part of the closing tab (6) in the area of the connection end (8) is bent by 180° against the remaining part of the closing tab (6) so that a part of the inner surface (11) is fixed to the support body (7) in a permanent and inseparable manner.

5. The pack (1) according to claim 1, wherein:

the closing tab (6) has an inner surface (11) facing the pocket (4) and an outer surface (12) facing away from the pocket (4); and in an area of the connection end (8), part of the outer surface (12) is fixed to the support body (7) in a permanent and inseparable manner.

6. The pack (1) according to claim 1, wherein the upper wall (13) has a locking element (16), which engages the first through opening (15) only in the extraction position, can be removed by tearing and must be removed to allow the blister (3) to slide from the closing position to the extraction position.

7. The pack (1) according to claim 6, wherein the locking element (16) has a grippable end (17) which is bent by 90° relative to the rest of the locking element (16).

8. The pack (1) according to claim 1, wherein the lower wall (14) has a second through opening (18), which is present only in the extraction position.

9. The pack (1) according to claim 1, wherein the upper wall (13) and the lower wall (14) are connected to one another by means of a hinge (19) and are glued to one another by means of a permanent adhesive (10).

10. The pack (1) according to claim 1 and comprising a plurality of blisters (3), which are arranged parallel and next to one another.

11. The pack (1) according to claim 1 and comprising a first group of blisters (3), which are arranged parallel and next to one another on a first side of the support body (7), and a second group of blisters (3), which are arranged parallel and next to one another on a second side of the support body (7).

12. A method to produce the pack (1) according to claim 1 and comprising the steps of:

manufacturing the blister (3) provided with the pocket (4) housing the at least one product (2) and with the closing tab (6);

providing a flat blank (20) to form the lower wall (14) and the upper wall (13), which are hinged to one another; applying an adhesive at least on the lower wall (14);

laying the blister (3) on the lower wall (14) causing the connection end (8) to adhere to the lower wall (14) by means of the adhesive; and bending the upper wall (13) relative to the lower wall (14) so as to cause the upper wall (13) to come into contact with the lower wall (14), thus allowing the pocket (4) to go through the first through opening (15) of the upper wall (13).

* * * * *